United States Patent [19]

Zaglio

[11] 4,099,789

[45] Jul. 11, 1978

[54] DEVICE FOR THE ORIENTED COLLECTION OF STOCKINGS, PANTY-HOSE AND LIKE ARTICLES

[75] Inventor: Sergio Zaglio, Castiglione Delle Stiviere (Mantova), Italy

[73] Assignee: Calzificio Golden Lady S.a.s. di Grassi Nerino & C., Castiglione Delle Stiviere (Mantora), Italy

[21] Appl. No.: 755,290

[22] Filed: Dec. 29, 1976

[30] Foreign Application Priority Data

Sep. 24, 1976 [IT] Italy ..... 27652 A/76

[51] Int. Cl.[2] ..... B65G 51/02

[52] U.S. Cl. ..... 302/2 R; 223/43; 271/175; 271/189; 271/195; 302/21; 302/59

[58] Field of Search ..... 302/2 R, 21, 23, 59; 223/43, 112; 271/175, 189, 194, 195

[56] References Cited

U.S. PATENT DOCUMENTS

| | | | |
|---|---|---|---|
| 2,684,187 | 7/1954 | Kienel | 223/43 |
| 3,712,609 | 1/1973 | Robert | 271/175 |
| 3,829,165 | 8/1974 | Boon | 302/59 |
| 3,844,621 | 10/1974 | Tiranov et al. | 302/2 R |

FOREIGN PATENT DOCUMENTS

| | | | |
|---|---|---|---|
| 54,261 | 12/1967 | Poland | 302/2 R |

*Primary Examiner*—Evon C. Blunk
*Assistant Examiner*—James L. Rowland
*Attorney, Agent, or Firm*—Pollock, Vande Sande & Priddy

[57] ABSTRACT

In an arrangement for collecting and stacking hosiery articles in general, such as stockings, panty-hose and the like, coming from a circular hosiery knitting machine, an improvement consisting in that the suction plate of the temporary collection space has two arrays of perforations, one with more closely spaced holes and the other with widely spaced, longitudinally arranged holes, so as to create a whirling motion of air and a differential pressure field which aids in distending the articles so as to have them orderly dropping onto a rod-like supporting member positioned beneath said temporary collection space.

9 Claims, 10 Drawing Figures

Figure 1:
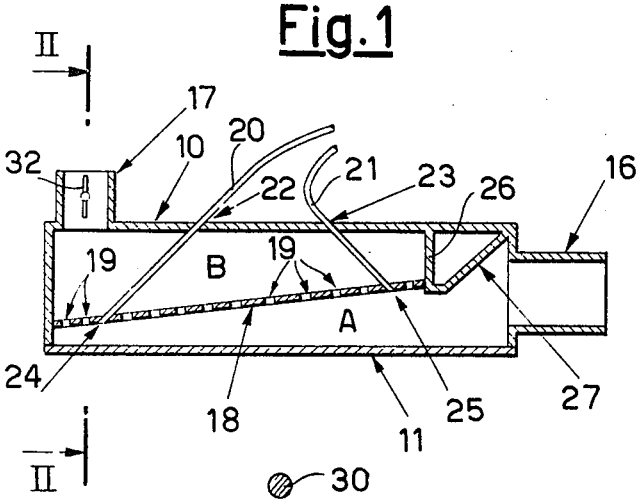

Fig.7
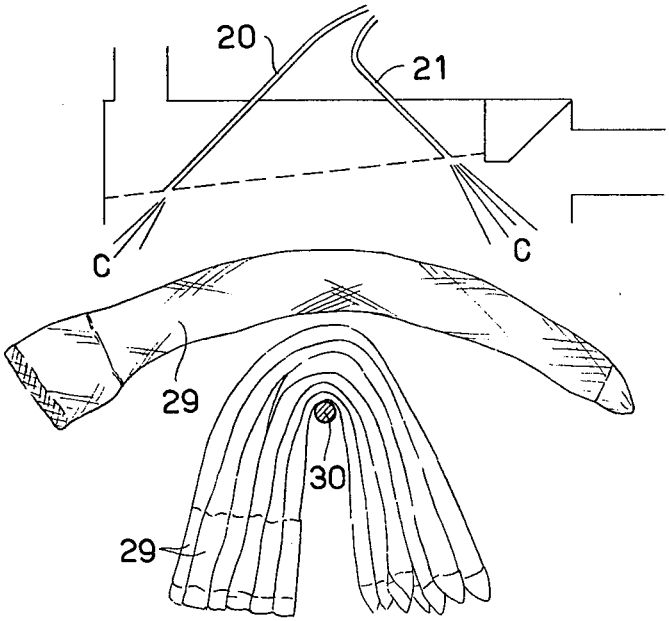
Fig.8
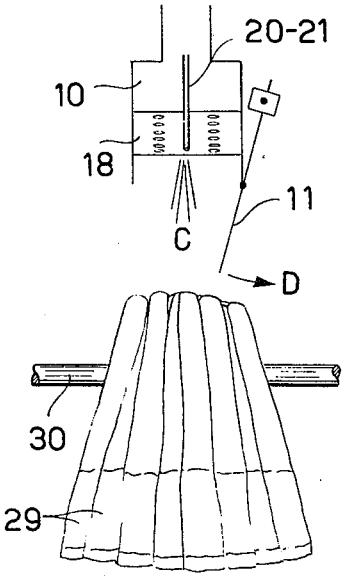
Fig.9
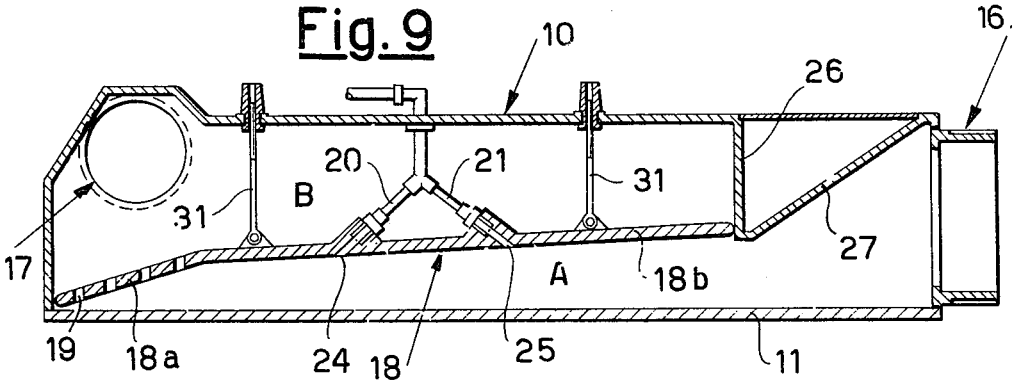
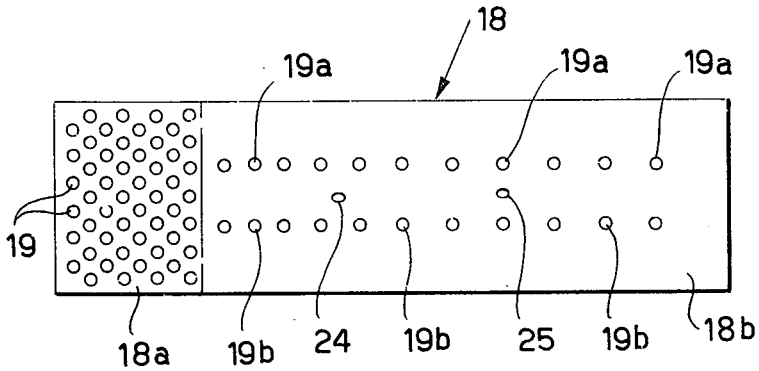
Fig.10

DEVICE FOR THE ORIENTED COLLECTION OF STOCKINGS, PANTY-HOSE AND LIKE ARTICLES

This invention relates to a device for the oriented collection of stockings, panty-hose and like articles.

The device according to the invention can be attached to one or more machines for the manufacture of stockings and like articles, but it can likewise be used in any other spot of the processing line for such articles, when it is desired to collect them in an oriented and orderly condition.

At any rate, the device is intended to be inserted in a line of pneumatic conveyance of the articles, in which these latter are fed in distended condition under the action of an appropriate dragging airstream through a conveyance duct.

The problem of the automatic collection, in an orderly and oriented manner, of articles such as stockings, panty-hose and the like has already been faced previously and has been solved heretofore according to the following concept. The article to be collected was caused to enter under the action of an airstream in completely distended condition along its entire length into a temporary collection space and, after such airstream was cut off, the article was discharged through a closable bottom opening of the temporary collection space while still maintaining its distended posture, for final collection in, or over, an appropriate collection means, such as a container. The discharge of the article in distended form from the temporary collection space in or on said final collection means took place by free fall.

The above indicated and summarily illustrated conventional devices have a number of defects.

In the first place, it should be observed that these devices require a considerable space on account of their length which, in any case, must be greater than the maximum length of the distended article to be collected. Such space is often unavailable on, or in the vicinity of, the machines used for making the articles, e.g., circular hosiery knitting machines for stockings. Be that as it may, the considerable bulk of the collecting device is normally a considerable drawback.

In addition, the discharge of the articles from the temporary collection space by free often fails to assure that the articles are arranged in fairly distended posture in or on the final collecting vessel.

An object of the present invention is thus to provide a device for the orderly and oriented collection of articles, such as stockings, panty-hose and the like which obviates the defects of prior art and, more particularly, has little bulk so as to be conveniently used even in rooms where space is at a premium.

To achieve this purpose in accordance with the invention, the article is temporarily collected in a space, not in distended form but in orderly heaped condition, without balling of the article, however, and is then discharged from said space while simultaneously being distended along its whole length, finally collecting it on an underlying supporting member which is adapted to hang the article in correspondence with a central area of such supporting member.

The device for the oriented collection of articles such as stockings, panty-hose and the like, according to the present invention, comprises an elongate body inserted in a pneumatic conveyance duct, said body defining a temporary collection space for one article at a time coming into said space from an end of said body, controllable door means for opening the lower portion of the space along the entire length thereof, a supporting member arranged beneath said door for receiving the articles discharged from said space, means for providing a dragging airstream in said conveyance duct and through said temporary collection space and means for cutting off said airstream downstream of said body. The temporary collection space has a length which is substantially shorter than the length of a distended article, and is limited at its top by a foraminous diaphragm arranged at a slope in said space, so that the space is gradually restricted from the article inlet side towards the opposite side. The supporting member adapted to receive the articles discharged from said space is spaced apart from said door substantially under the center thereof and transversely with respect to the longitudinal axis of the elongate body.

Preferably, a plurality of small tubes connected to a source of compressed air is attached to said foraminous diaphragm, said small tubes opening into the temporary collection space in a direction which diverges towards the ends of said space.

By connecting such small tubes to the source of compressed air at the instant at which the opening of the lower door of the temporary collection space is effected, air jects are caused to enter such space and to act upon the heaped articles which are about to drop, so that the air jets tend to act upon the article so as to achieve a thorough and reliable distension thereof.

It has been ascertained that, for the temporary collection of the articles in a space having a reduced length, and for a fairly ordered heaped arrangement of the articles within such a space, a factor of paramount importance is the metering of the suction air which causes an article to enter such space. As a matter of fact, the arrangement should be that the end of the article (generally the stocking's welt) which first enters the temporary collection space may reliably reach the bottom of such space, i.e. the point at which the space is narrowest, due to the arrangement of the foraminous diaphragm with a slope.

In addition, it is necessary to maintain the suction action after the end of the article has reached the bottom of the space and to direct such action on the remaining portion of the article with gradually decreasing intensity, as the article is gradually being heaped in the collection space.

Given the availablity of that a suction source which has a constant draw force and which unfolds its action in the temporary collection space through the foraminous diaphragm, it has been ascertained that the distribution and the closeness of the perforations through said diaphragm are of particular importance. Advantageous results have been obtained with a diaphragm which, in its terminal portion at the far end of the collection space, has a close array of perforations while in the portion which extends from the latter close-perforation area towards the inlet end of the collection area, the diaphragm has discrete longitudinal hole rows, which are progressively farther spaced apart from each other in the direction of said inlet end.

With a like distribution of the holes throughout said diaphragm, a reliable air jet is obtained at the end of the article which first enters, down to the bottom of the collection space, with a progressive obstruction of the holes by the incoming article and with an air draft having a gradually decreasing intensity on the remaining portion of the article in the collection space.

In addition, it has proven desirable to have a diaphragm the end portion of which has close perforations and is slightly bent relative to the diaphragm plane, so that the temporary collection space may narrow at its distal end more intensively than at its inlet end. In this way a wider space is provided for the portion of the article which first enters the collection space and more even and reliable stacking is obtained for the entire article within a narrow space. Such a shaping of the diaphragm is especially advisable in the case in which the article to be collected has an end portion which is particularly bulky, such as for example panty-hose which usually has, in its waist portion, a heavier fabric texture and an elastic welt, with a volume of considerably greater bulk than the welt portion of a standard stocking.

By means of the present invention, it is possible to reduce the length of the temporary collection space to about one-fifth of the overall length of a standard ladies' stocking.

In order that a more reliable distension of the article may be obtained in the instant at which it drops freely from the temporary collection space (when the lower door is caused to open upon discontinuance of the suction it has proven to be an advantage to have the jets of compressed air introduced in the collection space in diverging directions starting from closely spaced points substantially in the center of the foraminous diaphragm which confines the top of the collection space. This causes the air jets to distend the stacked article which is being dropped evenly in opposite directions. The objective is thus achieved of having the distended article arranged with its central portion on the underlying final collection supporting member while preventing asymmetrical positioning of said article astride said supporting member.

Figure 2:
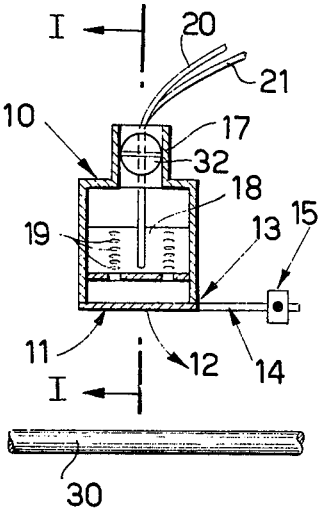

The collection device according to the present invention will now be more fully illustrated by way of example with reference to the accompanying drawings, wherein:

FIGS. 1 and 2 are respective longitudinal and transverse cross-sectional views of the device, taken along the line I—I of FIG. 2 and II—II of FIG. 1, respectively.

Figures from 3 to 8 are diagrammatical showings of the operation of the device.

FIG. 9 is a longitudinal cross-sectional view of the device, similar to FIG. 1, according to a preferred embodiment, and FIG. 10 is a plan view of the diaphragm which confines the temporary collection space in the embodiment shown in FIG. 9.

The device (FIGS. 1 and 2) is substantially composed of a body 10 which in the example shown has the shape of a rectangular base parallelepiped, the bottom of which is a movable door 11. The latter can open in the direction of the arrow 12 relative to the body 10 and is pivoted at 13 along one of its longitudinal borders.

The movable door 11 has attached thereto, by means of a pin 14 integral therewith, a counter weight 15, adjustable on said pin, so as to produce a nearly unstable equilibrium position of door 11 which, thus, is very, very slightly ajar.

Two fittings 16 and 17 are provided on body 10, of which the fitting 16 is intended to be connected to a pneumatic conveyance duct through which the articles to be collected enter sequentially. For example, this duct can convey the stockings from the cylinder of a circular knitting machine for hosiery. Fitting 17 is connected to a pneumatic suction installation (not shown) and has a controllable cutoff valve 32 therein, which is adapted to close at a certain instant the connection with said installation so as to stop the suction action, as will be explained in more detail hereinafter.

The body 10, by means of a diaphragm 18, is partitioned into two zones, A and B. This diaphragm is arranged substantially diagonally within the body 10 so that zone A communicates with fitting 16, through which the articles to be collected arrive, whereas zone B communicates with fitting 17, which is connectable to the suction installation.

Zone A is a temporary collection space for individual incoming articles and this space is progressively narrowed from the inlet side of the articles towards the opposite end.

Diaphragm 18 has an array of holes 19 which permit air to pass from zone A to zone B.

In a preferred embodiment, as shown in FIGS. 9 and 10, diaphragm 18 has an end portion **18*a* which is slightly bent relative to the portion 18*b* so that the space A is narrowed starting from the inlet end (fitting 16**) slowly at the outset and then, in the end section, more abruptly.

In this embodiment, the end portion **18*a* of the diaphragm exhibits a closely-spaced perforation with a plurality of closely spaced apart holes 19, whereas in the portion 18*b* there are formed two rows of holes 19*a* and 19*b*: in each of these rows, the holes become more and more widely spaced apart from each other with a certain graduality starting from the close-perforation end area, as can clearly be seen in FIG. 10. The diaphragm 18 is hung in a registrable manner in the interior of the body 10 by means of rods 31. Thereby, making it possible either to increase or to decrease the volume of the collection space A consistently with the kind of article to be collected. A wall 26 in the body 10 serves to support the diaphragm, while a sloping wall 27 is intended to prevent whirling air motions in transition between fitting 16** and the space A.

The diaphragm 18 has fastened thereto two tiny flexible tubes 20 and 21 which pass through body 10 at 22 and 23 and whose open ends 24 and 25 point towards chamber A at an angle relative to the diaphragm, whereas the opposite ends are connected in parallel by a pneumatic valve (not shown) to a compressed air source.

In the embodiment according to FIGS. 9 and 10, tubes 20 and 21 are connected by a single pipe to the compressed air source. In addition, it should be observed that openings 24, 25 of tubes 20, 21 approach one another in the central portion of space A.

A supporting member 30 is spaced apart from the lower door 11 and is substantially beneath the center of the door. In the example shown, the supporting member 30 is a rod placed transversely relative to the longitudinal axis of body 10 and is intended to receive the articles dumped from space A.

Figure 3:
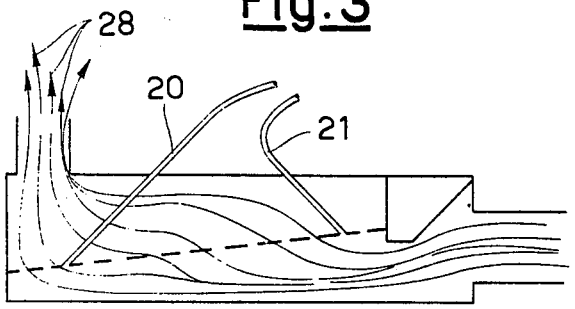

The operation of the device is as follows:

Assuming that the device is inserted in a pneumatic coneyance duct which is an integral part of a circular hosiery knitting machine, during the formation of a stocking in the cylinder of the machine valve 32 is open (as shown in FIG. 1) so that air suction takes place and body 10 of the device has an airstream flowing therethrough in the direction of arrows 28 (FIG. 3).

Figure 4:
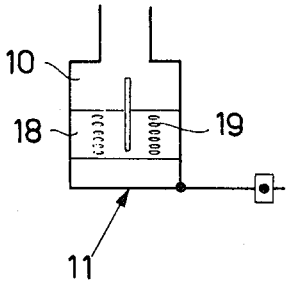

This airstream keeps under tension the stocking which is being formed within the cylinder and encourages the casting of a mesh. Due to the effect of suction, movable door 11 (FIG. 4), due to the external pressure, remains closed against body 10. When the stocking 29 is withdrawn from the needles (FIG. 5), due to the effect of suction it is maintained in distended condition and is caused to enter space A where it is stopped with its welt forward.

Especially in the preferred embodiment according to FIGS. 9 and 10, by virtue of zone 18*a* of the closely foraminous diaphragm 18, reliable suction is obtained for the portion of the stocking (the welt) which first enters space A down to the bottom of such space. As the stocking gradually enters space A and is orderly stacked therein, the stocking gradually obstructs the holes of the diaphragm 18 so that a suction of decreasing magnitude is obtained relative to the remaining portion of the stocking in the collection space.

Figure 5:
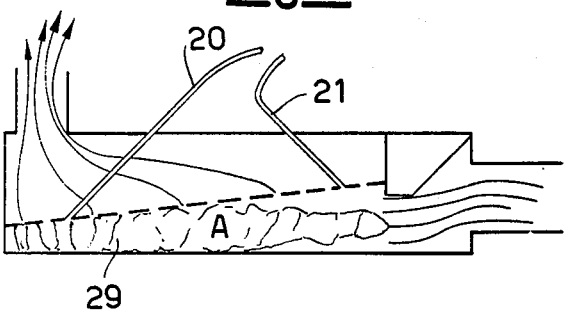
Figure 6:
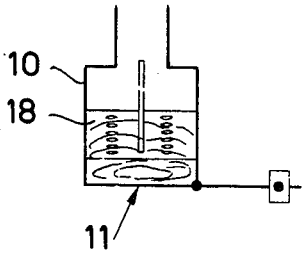

As soon as the entire stocking has entered space A and has been stacked therein as diagrammatically shown in FIG. 5, an appropriate control closes the cutoff valve 32, and immediately thereafter tubes 20 and 21 are placed in communication with the compressed air source (FIGS. 7 and 8). The searching oriented objects C emerging from openings 24, 25 of tubes 20, 21 cause lower door 11 to be opened in the direction of arrow D (FIG. 8) and the stacked stocking is dumped by being dropped freely from space A.

Concurrently with the drop of the stocking, the latter is also distended by virtue of the cooperative action of such oriented air jets which, acting upon the stocking, tend to stretch it in opposite directions. Thus, the stocking becomes arrayed on the underlying central supporting member 30 which, due to its being arranged transversely of the longitudinal axis of body 10, stops the fall of the stocking. The stocking thus remains on suppporting member 30, from which it hangs half on one side half on the other, as shown in FIGS. 7 and 8.

The stockings as sequentially dumped from body 10 through door 11 are orderly collected in a bundle on supporting member 30, with all the tips pointing in the same direction.

It may be pointed out that it is not always necessary to resort to compressed air jets to distend the articles as they freely fall from the temporary collection space. In the case of comparatively heavy articles, e.g., those produced on coarse-gauge machines or on machines for the production of men's garments, it is even possible to dispense with the air jets as auxiliary means for distending the articles temporarily collected in a stacked condition. In such cases, the article can be merely dropped in stacked condition from the temporary collection space onto a central underlying supporting member, whereby the article is automatically positioned astride of the supporting member and becomes distended by virtue of its own weight.

As is apparent from the foregoing disclosure, the bulk of the collecting device according to the present invention is greatly reduced and it has been possible to confine its overall length within the boundary of about 20 centimeters (8 feet). Whenever the collection device is intended to service a plurality of hosiery machines, its fitting 16 should be connected to the machine concerned, and care should be taken by means of appropriate controls that the device is always fed with only one article at a time.

What I claim is:

1. Apparatus for the orderly collection of articles such as stockings, panty-hose and the like, in a temporary collection space shorter in length than said article to be collected, and for the subsequent deposit of said articles on a support, comprising (a) an elongated body inserted in a pneumatic conveyance duct, said body defining a temporary collection space for one article at a time entering said space from an inlet end thereof;

(b) control means for opening the lower portion of said space along the entire length thereof;

(c) a supporting member arranged beneath said lower portion of said space for receiving in substantially centered position the articles falling downwardly from said space upon opening of said lower portion;

(d) means for originating a dragging air stream within said conveyance duct and through said temporary collection spce and means for cutting off said air stream down-stream of said body;

(e) said temporary collection space having a length substantially shorter than the length of said article;

(f) a perforated diaphragm defining the top of said space and arranged at an angle in said body so that said space is progressively narrowed from said inlet end towards the end opposite to said inlet end, whereby the perforations in said diaphragm become pregressively clogged as said article fills said space;

(g) said supporting member being spaced from said lower portion substantially beneath the center thereof and transversely relative to the longitudinal axis of said body.

2. Apparatus according to claim 1, including at least one small tube controllably connected to a source of compressed air, said small tube opening through said diaphragm into said temporary collection space.

3. Apparatus according to claim 2, including two said small tubes which open into said temporary collection space in directions which substantially diverge towards opposite ends of said space.

4. Apparatus according to claim 3, characterized in that said small tubes are attached to a substantially central zone of said diaphragm.

5. Apparatus according to claim 1, wherein said diaphragm has in its end portions, corresponding to said end opposite to said inlet and of said temporary collection space, an area with numerous close-spaced perforations and, in its portion which extends from such area towards said inlet end of said space, individual longitudinal rows of holes whose spacing from one another increases in the direction of said inlet end.

6. Apparatus according to claim 5, wherein said end portion of said diaphragm is bent relative to the plane of said diaphragm so as to narrow the temporary collection space in its end portion more abruptly than in its initial portion.

7. Apparatus according to claim 1, including means for vertical adjustment of the position of said diaphragm in said body.

8. Apparatus according to claim 1, wherein said lower portion of said temporary collecting space comprises a door and including an adjustable weight which keeps said door only slightly ajar.

9. Apparatus according to claim 1, wherein said supporting member has the shape of a rod.

* * * * *

UNITED STATES PATENT AND TRADEMARK OFFICE

CERTIFICATE OF CORRECTION

PATENT NO. : 4,099,789

DATED : July 11, 1978

INVENTOR(S) : Sergio Zaglio

It is certified that error appears in the above-identified patent and that said Letters Patent are hereby corrected as shown below:

"Mantova" is misspelled under "Assignee"

although it is correctly spelled under "Inventor".

Insert priority data:

| | | |
|---|---|---|
| -- July 19, 1976 | Italy | 25430 A/76 |
| Sep. 24, 1976 | Italy | 27652 A/76 --. |

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*